US011298944B2

(12) United States Patent
Osborne et al.

(10) Patent No.: US 11,298,944 B2
(45) Date of Patent: Apr. 12, 2022

(54) TANKS FOR PRINT CARTRIDGE

(71) Applicant: Hewlett-Packard Development Company, L.P., Spring, TX (US)

(72) Inventors: William S Osborne, Corvallis, OR (US); John J Cantrell, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 113 days.

(21) Appl. No.: 16/958,200

(22) PCT Filed: Jan. 25, 2018

(86) PCT No.: PCT/US2018/015118
§ 371 (c)(1),
(2) Date: Jun. 26, 2020

(87) PCT Pub. No.: WO2019/147238
PCT Pub. Date: Aug. 1, 2019

(65) Prior Publication Data

US 2021/0070055 A1 Mar. 11, 2021

(51) Int. Cl.
*B41J 2/175* (2006.01)

(52) U.S. Cl.
CPC ..... *B41J 2/17509* (2013.01); *B41J 2/17523* (2013.01)

(58) Field of Classification Search
CPC .... B41J 2/17509; B41J 2/17523; B41J 2/175; B41J 2/17513; B41J 2/1752; B41J 2/17553; B41J 2/17566; B41J 29/02
USPC ..... 347/85
See application file for complete search history.

(56) References Cited

U.S. PATENT DOCUMENTS

| | | | |
|---|---|---|---|
| 4,999,652 | A | 3/1991 | Chan |
| 5,363,130 | A | 11/1994 | Cowger et al. |
| 5,801,737 | A | 9/1998 | Sato et al. |
| 5,988,802 | A | 11/1999 | Pawlowski, Jr. et al. |
| 5,992,990 | A | 11/1999 | Childers et al. |
| 7,077,514 | B2 | 7/2006 | Inoue et al. |
| 7,490,928 | B2 | 2/2009 | Suzuki et al. |
| 2003/0025773 | A1 | 2/2003 | Koizumi |

(Continued)

FOREIGN PATENT DOCUMENTS

| | | | |
|---|---|---|---|
| EP | 2479032 | A1 | 7/2012 |
| WO | WO-2013165012 | A1 | 11/2013 |

*Primary Examiner* — Kristal Feggins
*Assistant Examiner* — Alexander D Shenderov
(74) *Attorney, Agent, or Firm* — HP Inc. Patent Department

(57) ABSTRACT

An example system includes an ink tank including a feeder tank, wherein the feeder tank is to hold a fluid therein, the feeder tank having a port, the feeder tank being under a negative gauge pressure. The example system further includes a print cartridge in fluid communication with the port of the feeder tank, the print cartridge having a nozzle plate. The port of the feeder tank is positioned to a lower corner of the feeder tank distally to the print cartridge, wherein the nozzle plate is disposed above a predetermined level within the feeder tank when the system is not tilted, the predetermined level corresponding to a free surface of a predetermined volume of the fluid when the system is not tilted. When the system is tilted to position the nozzle plate below the port, the volume of fluid uncovers the port.

15 Claims, 10 Drawing Sheets

(56) References Cited

U.S. PATENT DOCUMENTS

| | | | | |
|---|---|---|---|---|
| 2004/0217995 | A1* | 11/2004 | Matsushita | B41J 2/0451 347/7 |
| 2005/0099473 | A1 | 5/2005 | Katayama | |
| 2011/0090292 | A1* | 4/2011 | Iwasaki | B41J 2/17509 347/85 |

* cited by examiner

TANKS FOR PRINT CARTRIDGE

BACKGROUND

Printers are commonplace in both home environments and office environments. Such printers can include laser printers, inkjet printers or other types of printers. Generally, inkjet printers include printheads which deposit ink onto a print medium, such as paper. The printheads may move across the width of the print medium to selectively deposit ink to produce the desired image. Inkjet printers create images from digital files by propelling droplets of ink onto paper or other materials. The droplets are deposited from nozzles in a printhead assembly as the printhead assembly traverses a print carriage while the paper is advanced.

BRIEF DESCRIPTION OF THE DRAWINGS

For a more complete understanding of various examples, reference is now made to the following description taken in connection with the accompanying drawings in which.

DETAILED DESCRIPTION

Figure 1A:
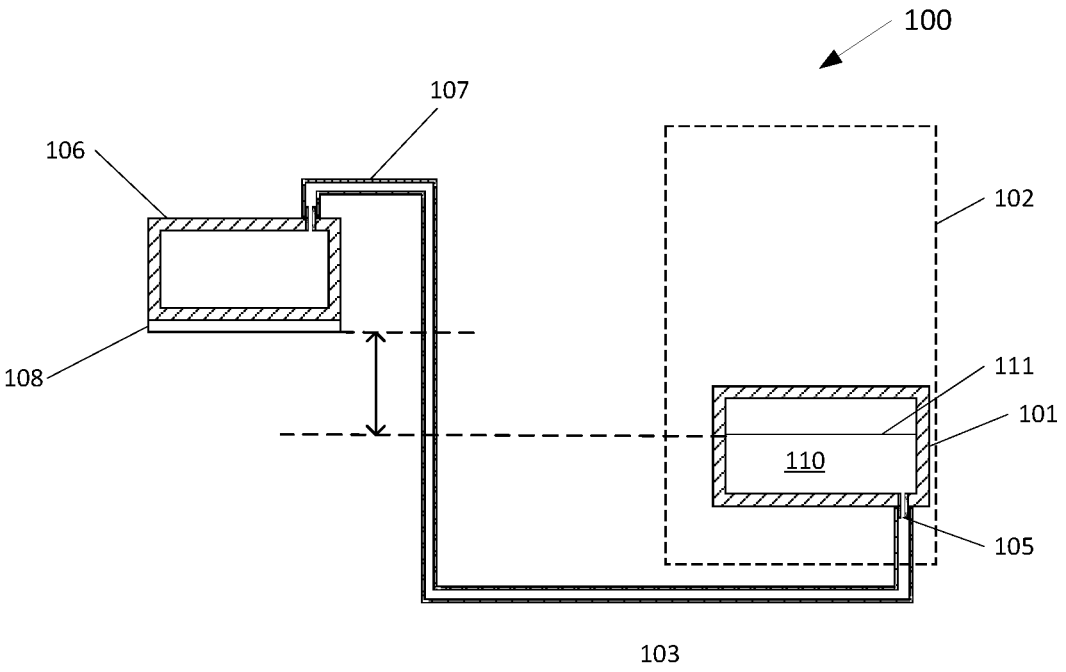
FIGS. 1A and 1B illustrate a sectional view of an example system for passive prevention of ink drool in a non-tilted position (FIG. 1A) and a tilted position (FIG. 1B)

As noted above, inkjet printers create images from digital files by propelling droplets of ink onto paper or other materials. The droplets are deposited from nozzles in a printhead assembly as the printhead assembly traverses a print carriage while the paper is advanced. Under certain conditions, such as during transport or storage, ink may leak or drool from the printer. For example, if the printer is being moved from one location to another and is tipped or tiled in the process, ink may leak from the printhead. Some inkjet printers may include some active mechanism, such as clamps or mechanical valves, for example, to prevent ink from leaking from the printhead when the printer is not in operation.

In some examples, inkjet printers with continuous ink supply systems (CISS) use print cartridges in a printhead assembly that are attached to fixed, refillable ink tanks by flexible tubes. The flexible tubes allow the print cartridges to move with the printhead assembly as it traverses a print carriage during the printing process. In some examples, the relative positions of the ink tanks and the print cartridges in normal printing operations may prevent leakage (otherwise known as ink drool) based on a negative gauge pressure (pressure relative to the pressure of the ambient atmosphere, or ambient atmospheric pressure) at the nozzle plate of the print cartridge, created by the relative positions of the ink tanks and the print cartridges. In some circumstances, such as a paper jam or movement of the printer from one location to another, the printer may be tilted enough to affect the relative positions of the ink tanks and the print cartridges, otherwise producing a positive gauge pressure (i.e., above ambient atmospheric pressure) at the nozzle plate that would allow ink drool.

In various examples, an inkjet printer includes an ink tank with a main tank and a vented feeder tank that is at least partially filled with ink. A flexible tube provides fluid communication between the feeder tank and a print cartridge in the printer via a port from the feeder tank. In one example, the port is located at a lower corner of the ink tank disposed away from (i.e., distal to) the center of mass of ink in the feeder tank, the tube and the print cartridge. The print cartridge includes a nozzle plate that generates ink droplets for printing (e.g., by thermal or piezoelectric mechanisms). In normal operation, where the printer is resting on a horizontal surface, the nozzle plate is located above the free surface of the ink in the feeder tank (i.e., the ink surface in the feeder tank that is vented to ambient atmosphere). This arrangement produces a negative gauge pressure at the nozzle plate that prevents ink drool.

If the printer is tilted from its normal operating orientation, for example to move the printer or clear a paper jam, there are at least two possible scenarios. In a first scenario, the tilting raises the nozzle plate with respect to the free surface of ink in the feeder tank, which increases the negative gauge pressure at the nozzle plate and prevents ink drooling.

In a second scenario, tilting the printer may lower the nozzle plate with respect to the free surface of ink in the feeder tank, which would otherwise create a net positive gauge pressure at the nozzle plate to allow ink drool. However, in one example, the configuration of the feeder tank insures that the port of the feeder tank is exposed to trapped air in the feeder tank before the nozzle plate drops below the free surface of the ink in the feeder tank. This condition creates a negative gauge pressure at the port that is sufficient to limit ink drool to the small volume of ink in the flexible tube between the feeder tank and the print cartridge.

In one example, a screen is fixed to the aforementioned port inside the feeder tank. The screen may be configured as a mesh and, in the normal operation of the printer, the screen is covered by ink in the feeder tank, allowing the free passage of ink toward the print cartridge as ink is ejected by the nozzle plate. However, if the printer is tilted so as to uncover the port (as in the second scenario described above), the screen remains wetted with ink and provides an increased negative gauge pressure, via surface tension, sufficient to prevent any ink drool from the print cartridge.

Figure 1B:
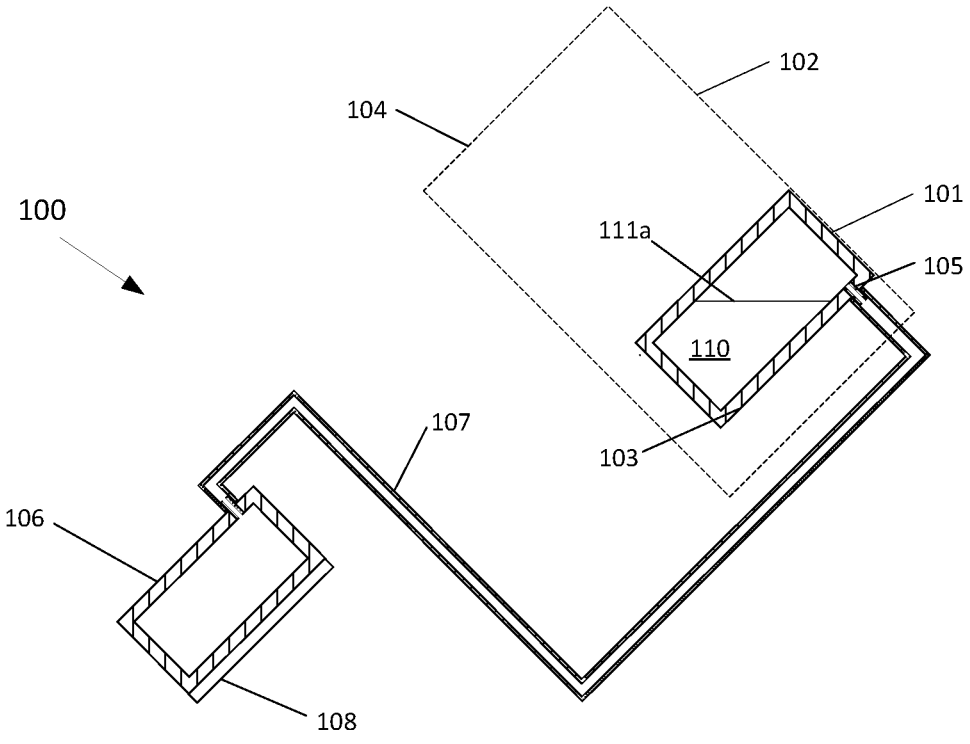

Turning now to the Figures, FIGS. 1A and 1B illustrate a sectional view of an example system for passive prevention of ink drool. FIG. 1A illustrates the example system 100 in a non-tilted position, and FIG. 1B illustrates the example system 100 in a tilted position. The example ink transfer system 100 includes a feeder tank 101, which is part of an ink tank 102 illustrated as an envelope in FIGS. 1A and 1B. The feeder tank 101 is to hold a fluid therein. In various examples, the fluid may be ink for printing in, for example, an inkjet printer. The feeder tank 101 includes a port 105 that is in fluid communication with a print cartridge 106. In various examples, the fluid communication may be through a flexible tube 107. The feeder tank is under negative gauge pressure, which may resist flow of the fluid from the feeder tank 101. In this regard, a negative gauge pressure may refer to a lower pressure within the feeder tank 101 than the pressure in the atmosphere, print cartridge 106 or the nozzle plate 108, for example.

The print cartridge 106 of the example system 100 includes a nozzle plate 108. In various examples, the nozzle plate 108 may include nozzles to dispense a fluid (e.g., ink) during a printing process. In the example system 100 of FIGS. 1A and 1B, the ink port 105 is positioned at a lower corner of the feeder tank 101, away from, or distally to, the print cartridge 106.

In normal operation of a printer in which the example system 100 may reside, the orientation of the example system 100 is in a non-tilted position, as illustrated in FIG. 1A. In this orientation, the nozzle plate 108 is located above a predetermined level 111 in the feeder tank 101. The predetermined level 111 corresponds to a free surface of a predetermined volume 110, which may be occupied by the fluid. In various examples, the predetermined volume 110 may be associated with a maximum or desired fill level of the fluid.

FIG. 1B illustrates the orientation of the example system 100 when the printer is tilted from its normal horizontal position, as in the case of physical relocation of the printer or clearing a paper jam, for example. In the tilted position illustrated in FIG. 1B, the nozzle plate 108 of the print cartridge 106 is below a volume level 111*a* in the feeder tank 101. The volume level 111*a* corresponds to the free surface of the predetermined volume of fluid noted above with reference to FIG. 1A. In various examples, when the example system 100 is tilted such that the position of the nozzle plate 108 is below the volume level 111*a*, as illustrated in FIG. 1B, the port 105 is above the volume level 111*a* and is uncovered by the fluid.

Figure 2A:
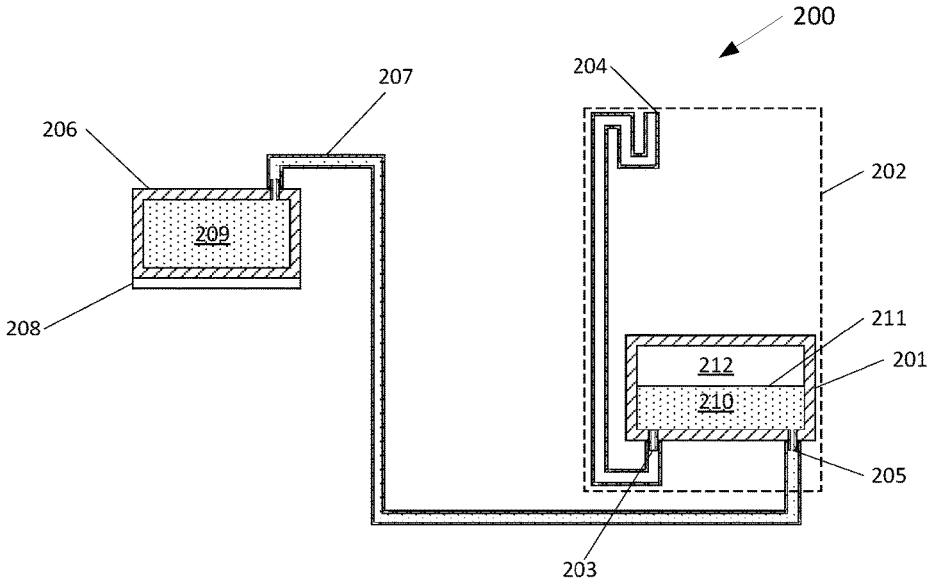
FIGS. 2A-2C illustrate a sectional view of another example system for passive prevention of ink drool in a non-tilted position (FIG. 2A), a first tilted position (FIG. 2B) and a second tilted position (FIG. 2C)
Figure 2B:
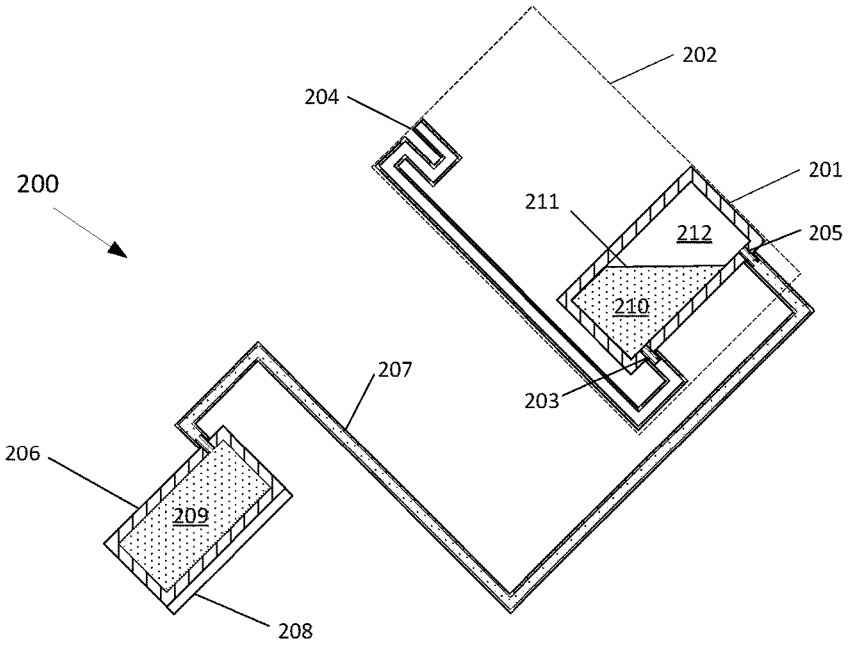
Figure 2C:
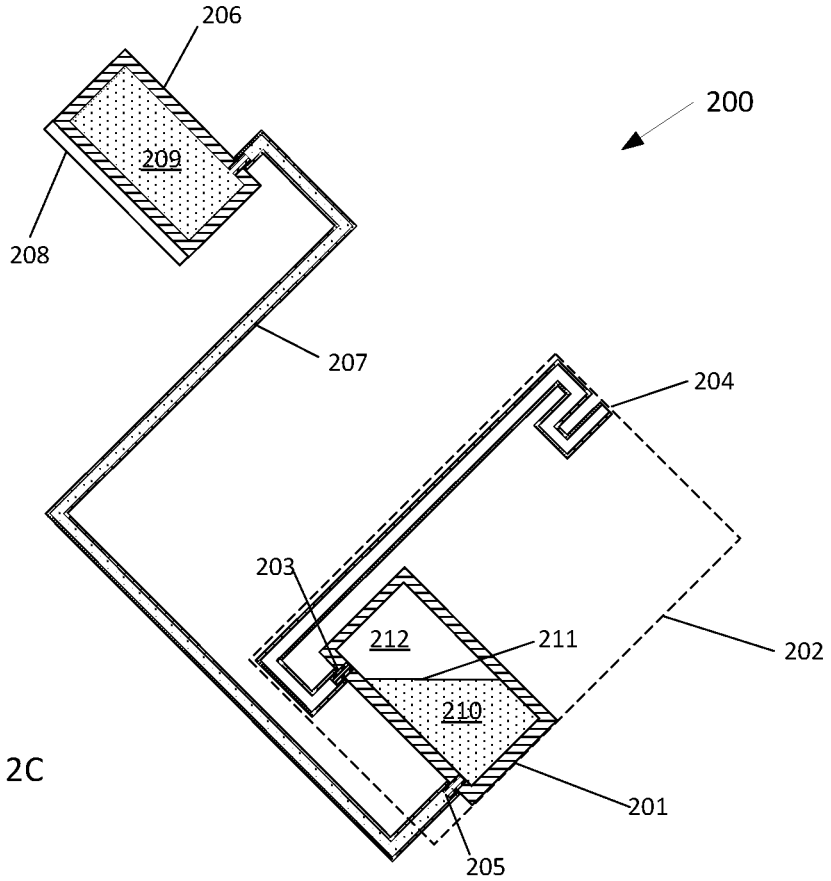

Referring now to FIGS. 2A-2C, another example ink transfer system 200 for passive prevention of ink drool is illustrated in a non-tilted position (FIG. 2A), a first tilted position (FIG. 2B) and a second tilted position (FIG. 2C). The example ink transfer system 200 includes a feeder tank 201, which is part of an ink tank 201 illustrated as an envelope in FIGS. 2A-2C, and which is described in greater detail below. The feeder tank 201 includes a vent port 203 connected to a vent 204 which vents feeder tank 201 to ambient atmosphere, or to ambient atomosheric air pressure. The feeder tank 201 includes an ink port 205 that is connected to a print cartridge 206 by a flexible tube 207. The print cartridge 206 includes a nozzle plate 208 to dispense ink during the printing process. In the example of FIGS. 2A-2C, the ink port 205 is located at a lower corner of the feeder tank 201, away from the center of mass of the ink 209 in the print cartridge 206 and the ink 210 in the feeder tank 201.

In the normal operation of a printer in which the ink transfer system 200 may reside, the orientation of the ink transfer system 200 is as illustrated in FIG. 2A. In this orientation, the nozzle plate 208 is located above the free surface 211 of the ink 210 in the feeder tank 201, which prevents any ink drool due to syphoning effects. Additionally, the vent port 203 and the ink port 205 are both covered by the ink 210 in the feeder tank 201. As the ink 209 is dispensed from the nozzle plate 208, it is replaced by the ink 210 from the feeder tank 201 through the flexible tube 207. As the ink 210 is removed from the feeder tank 201, the air 212 above the ink 210 exerts an increasing negative gauge pressure that resists the flow of ink 210 from the feeder tank 201. In various examples, before the negative gauge pressure is large enough to stop the flow of the ink 209, it exceeds the bubble pressure threshold of the ink 210, and air from the vent 204 bubbles into the feeder tank and reduces the negative gauge pressure in the feeder tank 201, allowing ink to continue to flow from the system.

FIG. 2B illustrates the orientation of the example ink transfer system 200 when the printer is tilted from its normal horizontal position, as in the case of physical relocation of the printer or clearing a paper jam, where the nozzle plate 208 of the print cartridge 206 is below the free surface 211 of ink 210 in the feeder tank 201. In these situations, the printer would not be printing and the print cartridge 206 would be docked at a maintenance station. In the orientation illustrated in FIG. 2B, the distal location of the ink port 205 ensures that the ink port 205 is uncovered by the ink 210 in feeder tank 201 before the nozzle plate 208 goes below the free surface 211 of the ink 210. When the ink port 205 is uncovered, it is exposed to the air 212 in the feeder tank 201 at a negative gauge pressure that opposes ink drool from the nozzle plate 208 that would normally occur due to gravitational syphoning forces. In a worst-case scenario, the maximum amount of ink drool is limited to the volume of ink in the flexible tube 207, which may be much less than one cubic centimeter in one example. As noted above, the print cartridge 206 may be docked at a maintenance station during the tilting event, and the maintenance station may have the capacity to absorb the limited amount of ink drool corresponding to the volume of ink in the flexible tube 207. It will be appreciated that the scenario shown in FIG. 2B (i.e., the nozzle plate 208 below the ink level as represented by the free surface 211) may arise in two different situations. The first, as illustrated in FIG. 2B, is where the front of the printer is lifted up. The second situation, not separately illustrated, is when the printer is tilted from the side in a way that moves the nozzle plate 208 below the ink level, or the free surface 211.

FIG. 2C illustrates the orientation of the example ink transfer system 200 when the printer is tilted in the opposite direction from the scenario illustrated in FIG. 2B. In the orientation illustrated in FIG. 2C, the nozzle plate 208 is above the free surface 211 of the ink 210 in the feeder tank, so there are no gravitational syphoning forces to induce ink drool.

Figure 3:
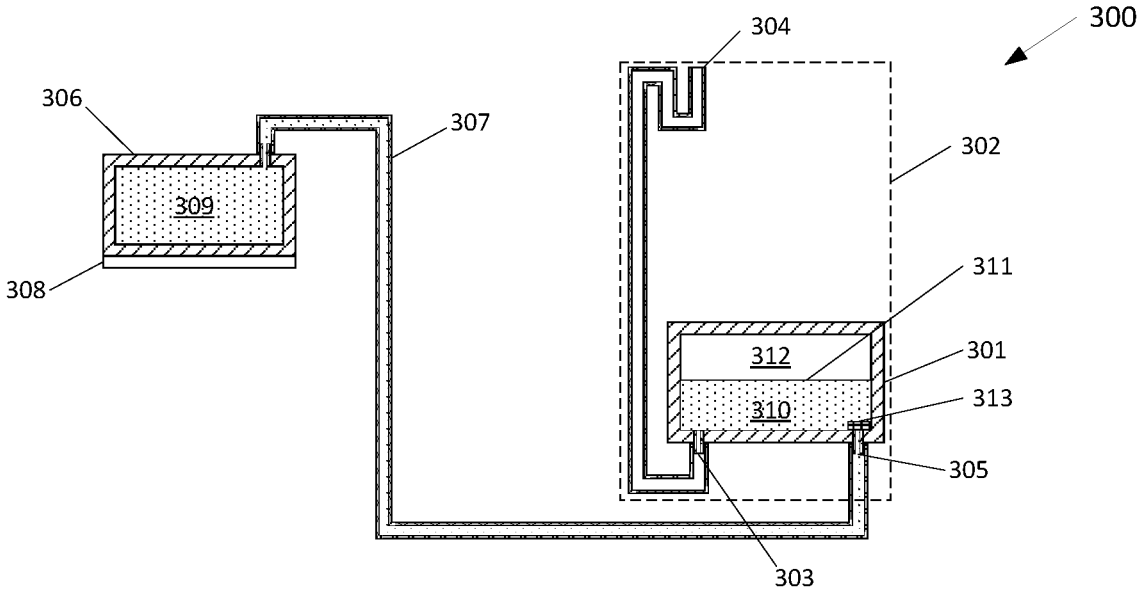
FIG. 3 is a sectional view of another example system for passive prevention of ink drool.
Figure 4:
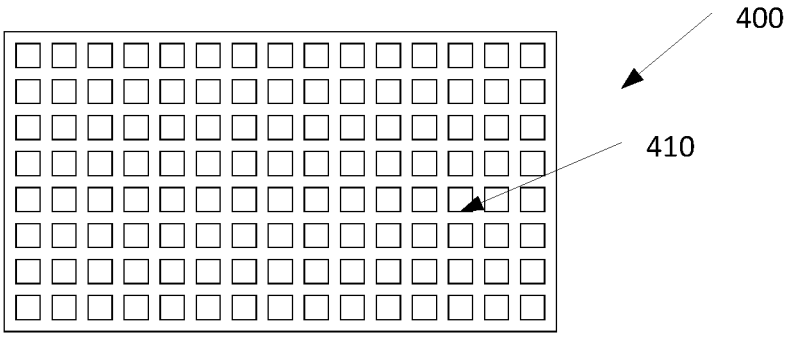
FIG. 4 illustrates an example screen for preventing ink drool in the example system of FIG. 3.

In one example system 300, as illustrated in FIG. 3, the feeder tank 301 may also include a porous screen 313 disposed at an interface between the feeder tank 301 and the ink port 305. In various examples, the screen 313 may be a regular arrangement of openings. An example screen 400 is illustrated in FIG. 4. The example screen 400 of FIG. 4 includes openings 410 arranged in a matrix pattern. In various examples, the openings 410 may be rectangular, circular or any other geometric shape. In other examples the screen 313 of the example system 300 may be a random mesh-like structure, analogous to steel wool, yet fabricated from a material that is resistant to corrosion, such as stainless steel or a plastic material such as polyurethane, or the like.

Figure 5:
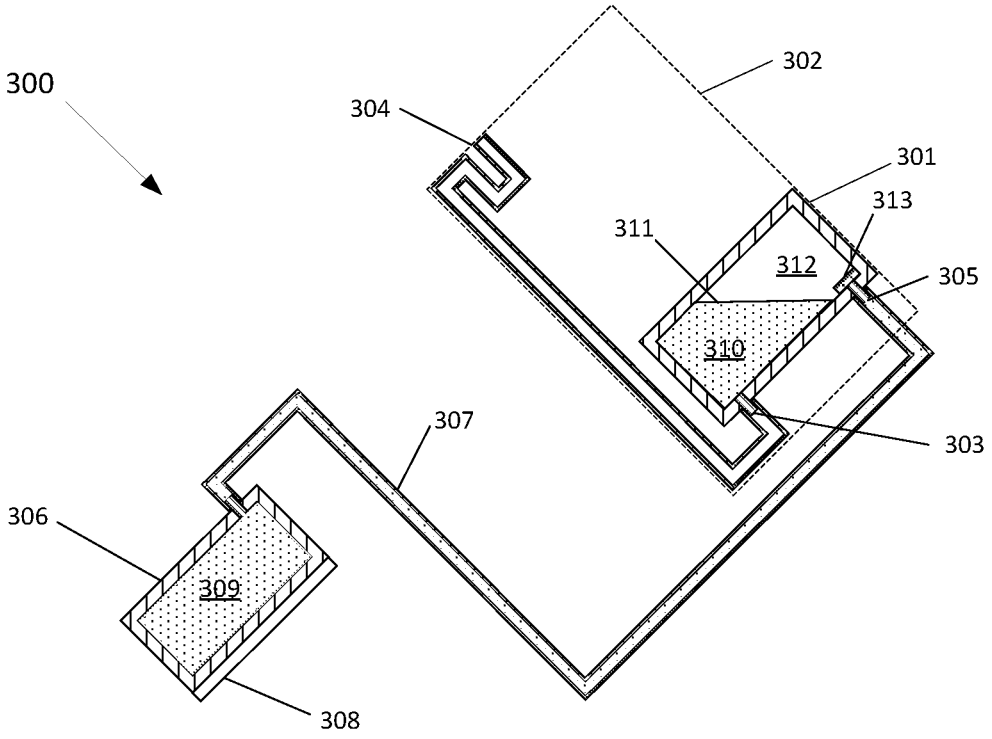
FIG. 5 illustrates the example system of FIG. 3 in a first tilted orientation.

In the orientation of the example system 300 illustrated in FIG. 3, the screen 313 is covered by the ink 310 in the feeder tank 301. In this state, the ink 310 is free to pass through the screen 313 so that ink can be delivered to the print cartridge 306 and dispensed by the nozzle plate 308. When the ink transfer system 300 is tilted as illustrated in FIG. 5, the screen 313 is uncovered, but remains wetted by ink and provides a negative gauge pressure, via surface tension, sufficient to prevent any ink drool from the nozzle plate 308.

Figure 7:
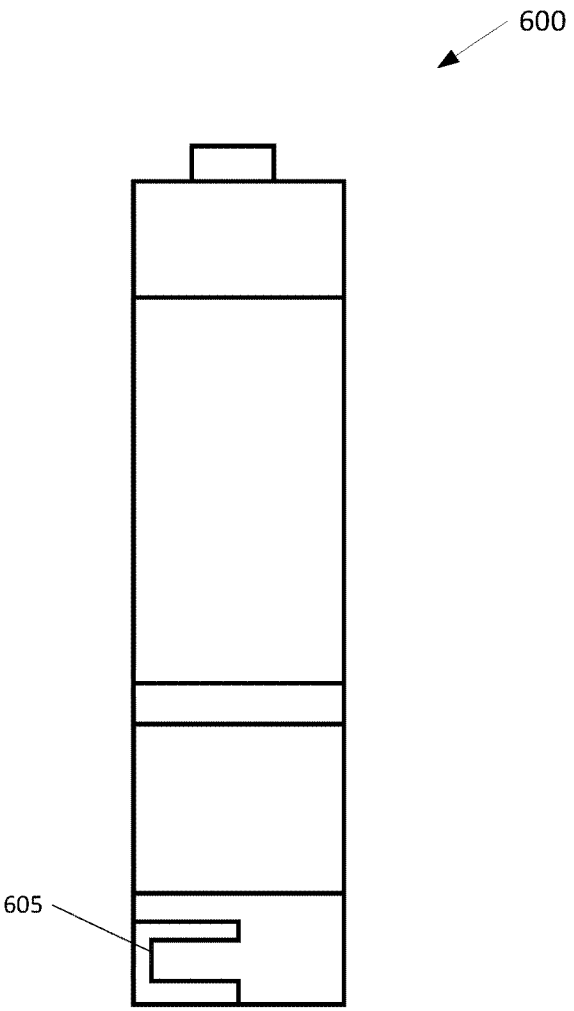
FIG. 7 is a side view of the example ink tank of FIG. 6.
Figure 6:
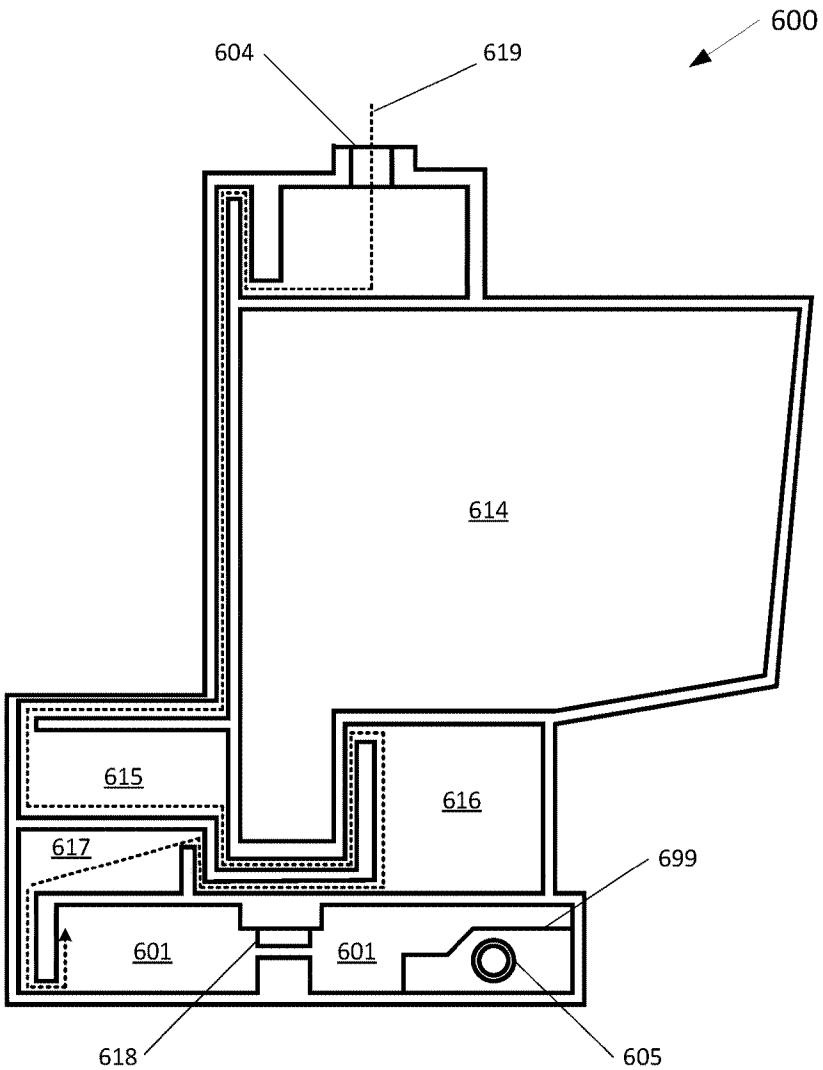
FIG. 6 is a sectional view of an example ink tank.

FIG. 6 is a cross-sectional view of an example ink tank 600 illustrating additional internal details. Illustrated in FIG. 6 are a feeder tank 601, vent 604, ink port 605 and a screen frame 699 to hold the screen 613 described above. The ink tank 602 also includes a main tank 614, overflow tanks 615, 616 and 617, and a "bubble sleeve" 618, which will now be described. The main tank 614 is a refillable tank that is normally sealed to outside air. The overflow tanks 615, 616 and 617 are part of the air path of the vent 604, which is illustrated by the dotted line 619 in FIG. 6. Normally, the overflow tanks 615, 616 and 617 contain no ink. However, if the ambient temperature increases, the volume of ink in the feeder tank 601 and the main tank 614 will increase due to thermal expansion and flow into the overflow tanks. The tanks prevent a pressure buildup that might otherwise force ink from the nozzle plate. The main tank 614 is in fluid communication with the feeder tank 601 via the bubble sleeve 618, which enables ink transfer between the main tank 614 and the feeder tank 601. FIG. 7 is a side view of the example ink tank 600 illustrating port 605 exiting horizontally.

Figure 8:
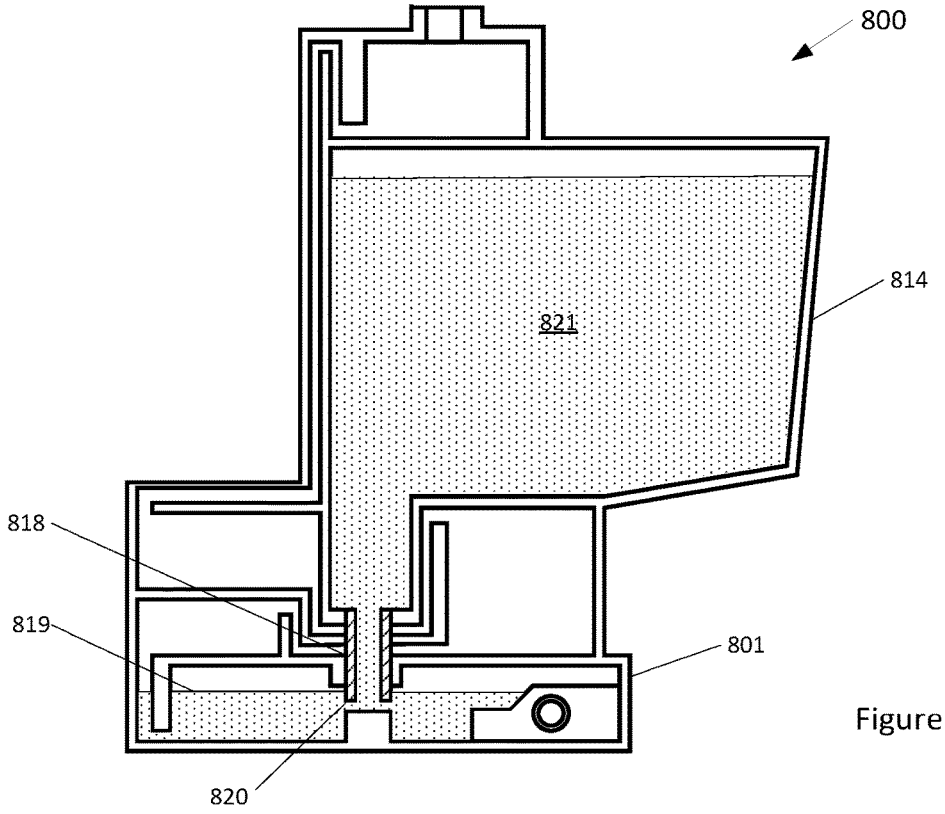
FIG. 8 is a sectional view of an example ink tank illustrating a first ink distribution.

FIG. 8 is a cross-sectional view of another example ink tank 800 illustrating details of a bubble sleeve 818. In one example, the bubble sleeve 818 is a tubular connection between a main tank 814 and a feeder tank 801. In the example of FIG. 8, the ink level 819 in the feeder tank 801 is above the lower opening 820 of the bubble sleeve 818, which prevents air from entering the main tank 814, and prevents ink 821 in the main tank 814 from flowing to the feeder tank 801 (due to back pressure in the sealed main tank 814). As ink is transferred from the feeder tank 801 to a print cartridge, as described above, the ink level 819 in the feeder tank 801 will drop. When the ink level 819 drops below the lower opening of the bubble sleeve 818, there will be an air-ink exchange as illustrated in FIG. 9.

Figure 9:
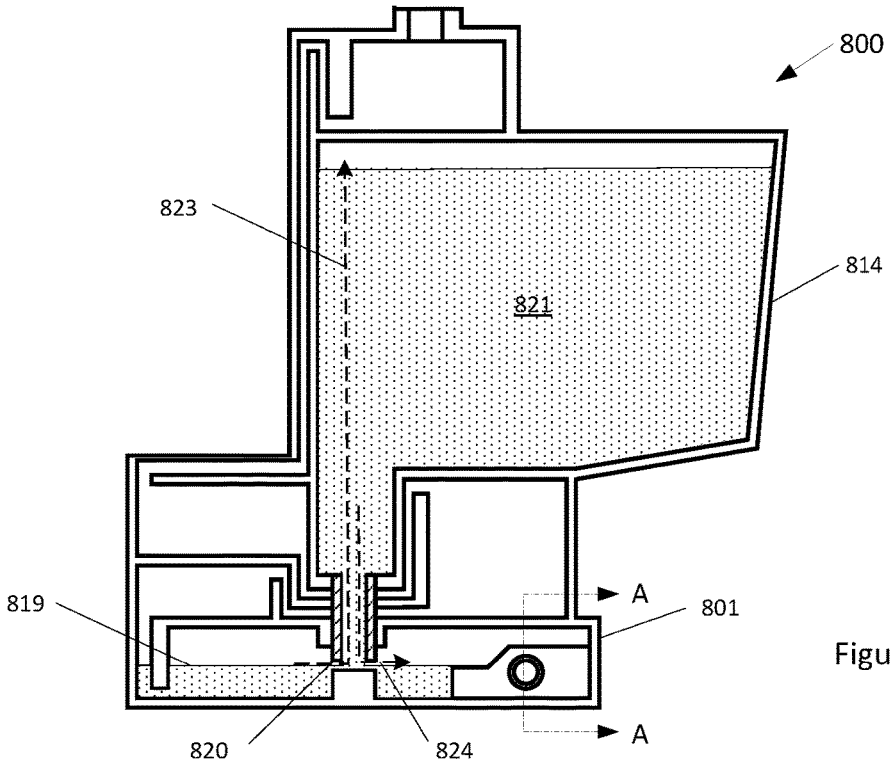
FIG. 9 is a sectional view of the example ink tank of FIG. 8 illustrating a second ink distribution.

In FIG. 9, the ink level 819 is below the lower opening 820 of the bubble sleeve, which allows air 822 in the feeder tank to bubble up into the main tank 814 as illustrated by the dotted arrow 823 in FIG. 9. As the air 822 bubbles into the main tank, an equal volume of ink 821 flows into the feeder tank 801, as illustrated by the dotted arrow 824 in FIG. 9. This exchange continues until the ink level 819 again covers the lower opening 820 of the bubble sleeve 818, and the air-ink exchange is interrupted. It will be appreciated that the bubble sleeve 818 operates like a valve during printing, which maintains the ink level 819 in the feeder tank 801 corresponding to the lower opening 820 of the bubble sleeve 818.

Figure 10:
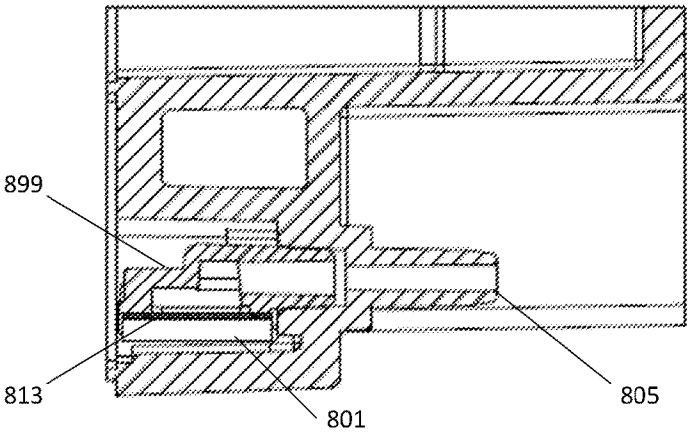
FIG. 10 is a sectional view of the example ink tank of FIG. 9 illustrating an example screen and frame assembly.
Figure 11:
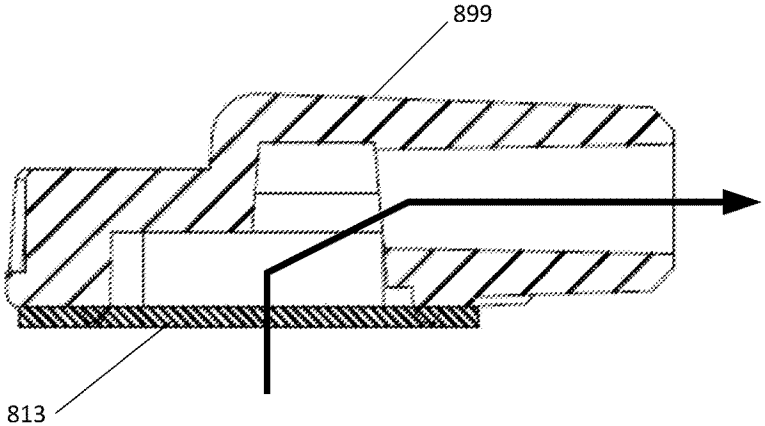
FIG. 11 is sectional view of the screen and frame assembly of FIG. 10.
Figure 12:
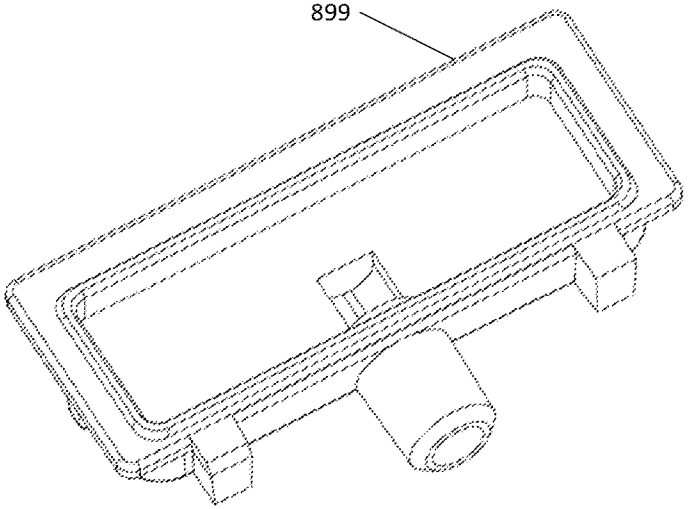
FIG. 12 is a perspective view of an example screen frame.

FIG. 10 is a sectional view of the example ink tank 800 through section A-A of FIG. 9, illustrating details of the screen 913 and the screen frame 899. In one example, the screen 813 is attached to the screen frame 899 and the combined assembly is press-fitted into an opening into the feeder tank 801. Thus, the opening is sealed, and fluid communication is established between the feeder tank 801 and the ink port 805. FIG. 11 is an enlarged sectional view of the screen 813 and the screen frame 899 where the direction of ink flow is indicated by the arrow. FIG. 12 is an enlarged perspective view of the screen frame 899 in an inverted position to illustrated internal details. In some examples, the openings or pores in the screen 813 may vary between about 2 microns and about 20 microns. In some examples, the thickness of the screen 813 may vary between about 0.05 millimeters and about 0.5 millimeters. In other examples, the area of the port 805 covered by the screen 813 may vary between about 20 square millimeters and about 500 square millimeters.

Figure 13:
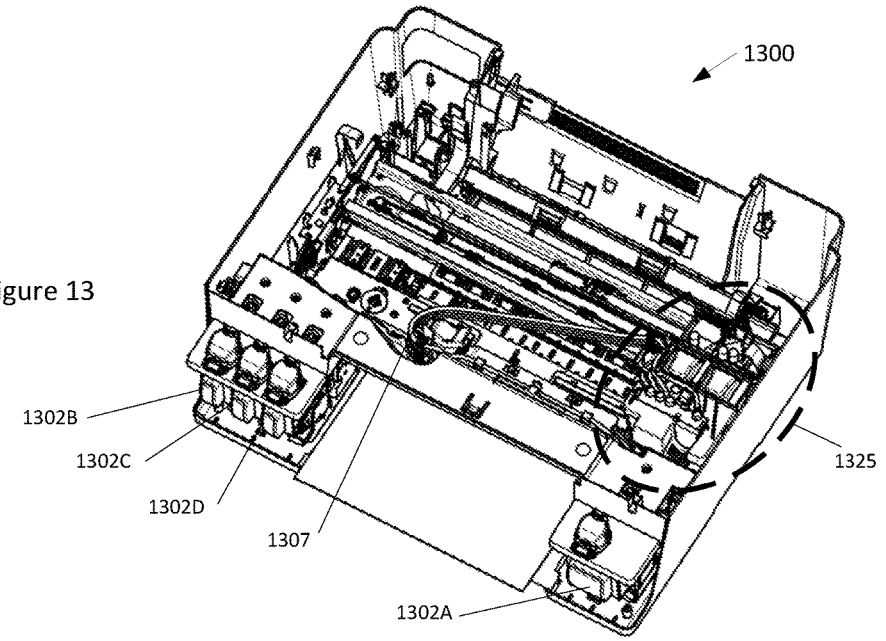
FIG. 13 is a perspective sectional view of an example printer illustrating an example ink delivery system.

FIG. 13 is a perspective view of an example printer 1300 with its top removed to expose the printer's ink delivery system. The example printer 1300 contains fixed ink tanks 1302 designated as 1302A, 1302B, 102C and 1302D. In one example, the ink tank 1302A may contain black ink, and ink tanks 1302B, 1302C and 1302D may contain, respectively, yellow ink, magenta ink and cyan ink to enable color printing. In other examples, there may be fewer than four ink tanks or more than four ink tanks, and the ink colors may be different (e.g., primary colors rather than complementary colors). The ink tanks (collectively 1302) may have ink level viewing windows that enable a user to determine when an ink tank 1302 needs to be refilled.

FIG. 13 illustrates the relative positions of the ink tanks 1302, the corresponding flexible tubes 1307, and an example printhead assembly 1325. In various examples, the example printhead assembly 1325 contains print cartridges 1306 (not separately identified in FIG. 13) corresponding to each of the ink tanks 1302.

Figure 14:
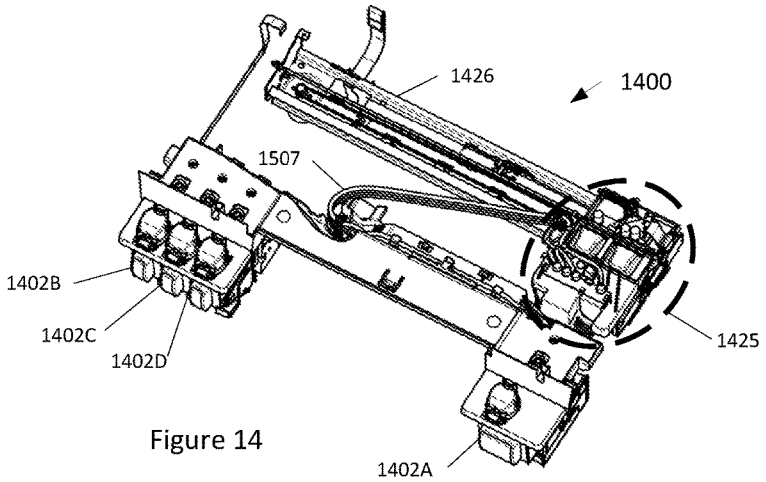
FIG. 14 is an isolated perspective view of an example ink delivery system.

FIG. 14 is a perspective view of an example ink delivery system 1400 that may be used with the example printer 1300 of FIG. 13. The example ink delivery system 1400 of FIG. 14 includes ink tanks 1402, flexible tubes 1407, a printhead assembly 1425, and a print carriage 1426 that transports the printhead assembly 1425 during printing. In FIG. 14, the printhead assembly 1425 is shown in its parked, non-printing position where it may be engaged with a printhead maintenance station (not shown).

Figure 15:
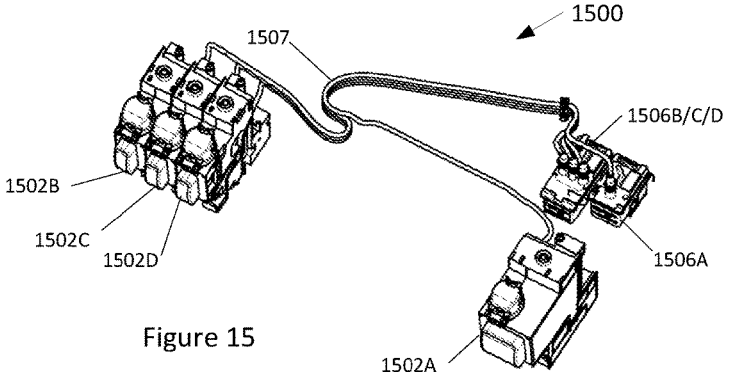
FIG. 15 is a perspective view of an example ink transfer system.

FIG. 15 is a perspective view of an example ink transfer system 1500 that may be used with the example printer 1300 of FIG. 13. The example ink transfer system 1500 of FIG. 15 is illustrated with four ink tanks 1502A, 1502B, 1502C and 1502D, the corresponding print cartridges 1506A, 1506B, 1506C and 1506D, and the corresponding flexible tubes, collectively 107. In the example of FIG. 15, the print cartridges 1506B, 1506C and 1506D are in one common subassembly.

Figure 16:
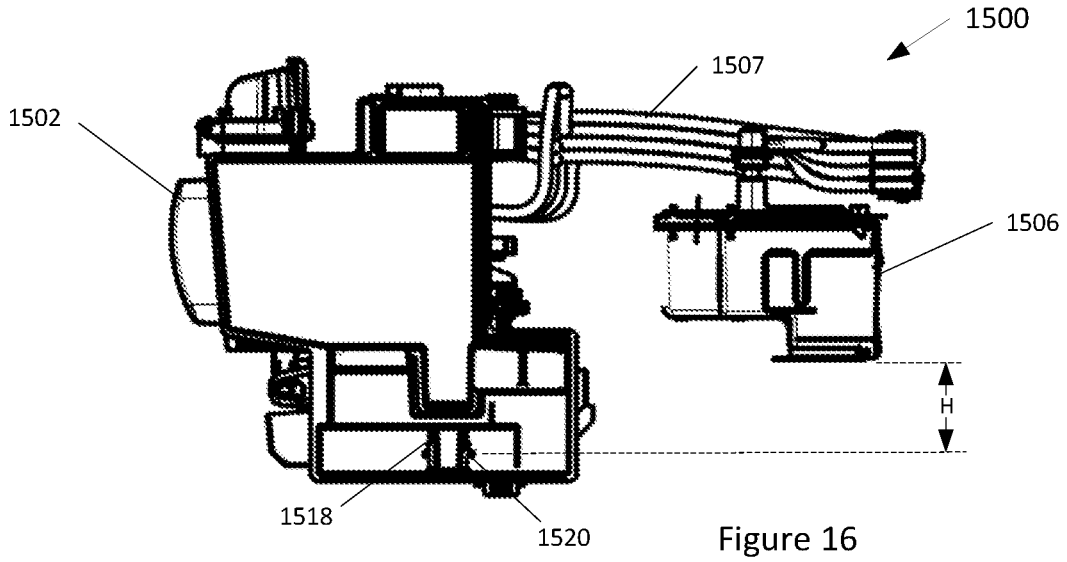
FIG. 16 is a side sectional view of the ink transfer system of FIG. 15.

FIG. 16 is a sectional side view of the ink transfer system 1500 of FIG. 15 illustrating the relative positions of an ink tank 1502 and an ink cartridge 1506. In particular, FIG. 16 illustrates the vertical distance between a nozzle plate 1508 and the lower opening 1520 of a bubble sleeve 1518. In one example, the distance "H" may be in the range of between about 0 inches and about 3 inches.

Figure 17:
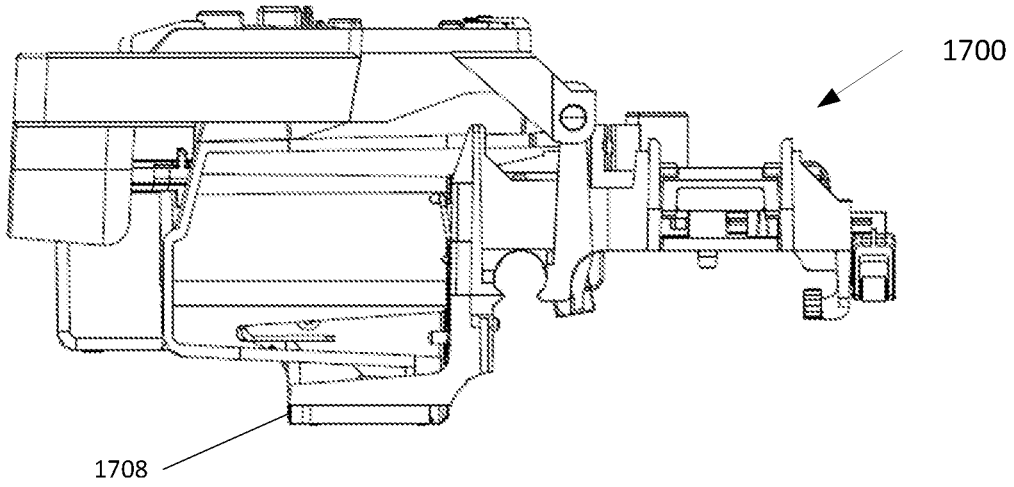
FIG. 17 is a side view of an example printhead assembly.
Figure 18:
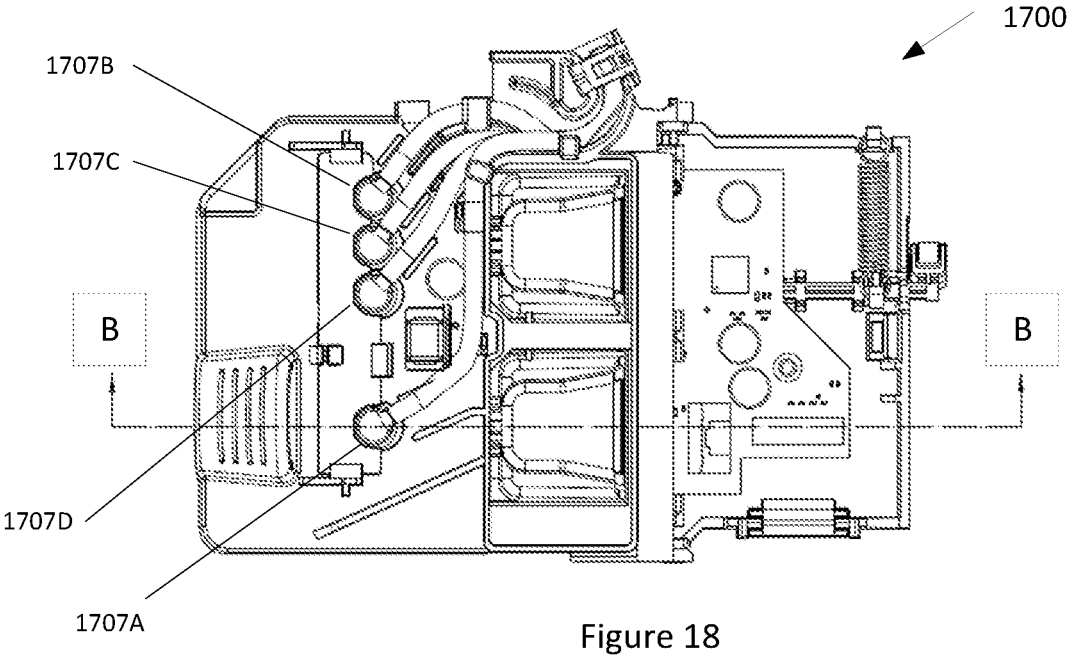
FIG. 18 is a top view of the example printhead assembly of FIG. 17.

FIG. 17 is a side view of an example printhead assembly 1700 illustrating an example location of a nozzle plate 1708. FIG. 18 is a top view of the example printhead assembly 1700 of FIG. 17. FIG. 18 illustrates the connections of flexible tubes 1707A, 1707B, 1707C and 1707D corresponding to each of the ink tanks, such as ink tanks 1502A, 1502B, 1502C and 1502D described above with reference to FIG. 15.

Figure 19:
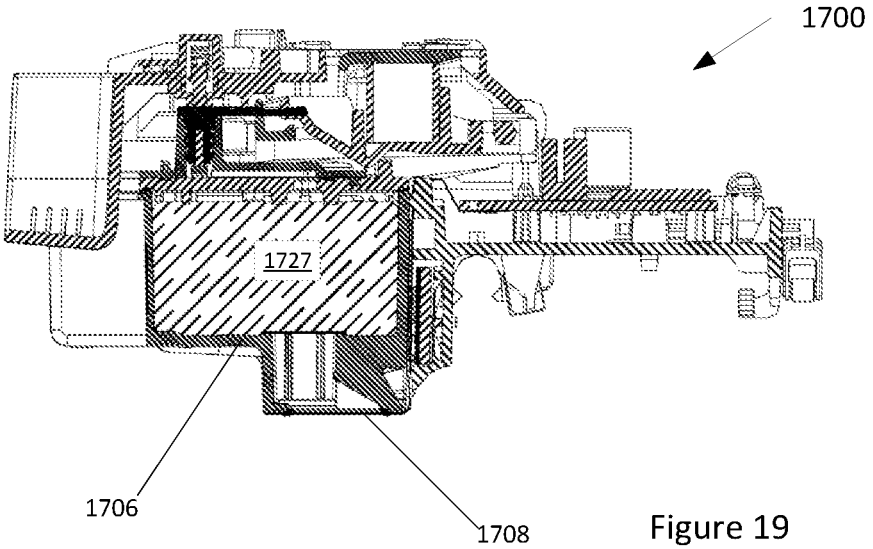
FIG. 19 is a sectional view of the example printhead assembly of FIGS. 17 and 18.

FIG. 19 is a sectional view of the example printhead assembly 1700 of FIGS. 17 and 18 taken through section B-B of FIG. 18 at the midline of print cartridge corresponding to the flexible tube 1707A. In one example, as illustrated in FIG. 19, the ink cavity of ink cartridge 1706 may be filled with a capillary medium 1727, such as a polyurethane foam or the like. The capillary medium 1727 operates to create a relatively high capillary pressure at the nozzle plate 1708 to further inhibit ink drool from the nozzle plate. In one example, the capillary pressure may be in the range of between about 1 inch and about 20 inches of water.

The foregoing description has presented examples of systems for passively inhibiting ink drool from a printhead in an inkjet printer. In one example, a disclosed system for passively inhibiting ink drool in an inkjet printer includes an ink tank with a vented feeder tank where the feeder tank is at least partially filled with ink. The example system also includes a print cartridge, where the print cartridge is in fluid communication with a port of the feeder tank at a lower corner of the feeder tank. The port may be disposed distally to a center of mass of ink in the feeder tank and the print cartridge. The print cartridge includes a nozzle plate to dispense ink. In one example, the nozzle plate is disposed below a free surface of ink in the feeder tank when the printer is in a first tilted orientation and the port is exposed to air in the feeder tank at a negative gauge pressure.

In one example, the system includes a screen disposed at an interface between the feeder tank and the port, where the screen is fabricated as a mesh to retain ink when the port is exposed to air in the feeder tank, and where the screen is operative to increase the negative gauge pressure at the port.

In one example, openings in the mesh are in the range of approximately 2 microns to approximately 20 microns. In one example, the thickness of the screen is in the range of approximately 0.05 millimeters to approximately 0.5 millimeters. In one example, the active area of the screen is in the range of approximately 20 square millimeters to approximately 500 square millimeters.

In one example, the feeder tank is vented to ambient atmospheric pressure and the ambient air replaces ink in the feeder tank as ink is transferred from the feeder tank to the print cartridge. In one example, the nozzle plate is located above the free surface of ink in the feeder tank when the printer is in a normal operating orientation and the port is covered by ink in the feeder tank.

In one example, the nozzle plate is located above the free surface of ink in the feeder tank when the printer is in a second tilted orientation and the port is covered by ink in the feeder tank. In one example, a disclosed system for passively inhibiting ink drool includes an ink tank, where the ink tank includes a main tank and a feeder tank in fluid communication with the main tank, and where the feeder tank is partially filled with ink. The example system also includes a print cartridge with a nozzle plate to dispense ink, and a tube to establish fluid communication between the print cartridge and a port of the feeder tank. In one example, the port is located at a lower corner of the feeder distally to a center of mass of ink in the feeder tank, the print cartridge and the tube. The example system may also a screen disposed at an interface between the feeder tank and the port, wherein the nozzle plate is located below a free surface of ink in the feeder tank when the printer is in a first tilted orientation and the port is exposed to air in the feeder tank, and where the screen is operative to provide a negative gauge pressure at the port. In one example, air in the main tank is maintained at a negative gauge pressure.

In one example, the system also includes a tubular sleeve extending from the main tank into the feeder tank, wherein a transfer of air from the feeder tank to the main tank is prevented when the free surface of ink in the feeder tank is above a lower lip of the tubular sleeve, wherein ink transfer from the main tank to the feeder tank is prevented.

In one example, a transfer of air from the feeder tank to the main tank is enabled when the free surface of ink in the feeder tank is below the lower lip of the tubular sleeve, wherein ink transfer from the main tank to the feeder tank is enabled.

In one example, a disclosed system for passively preventing ink drool includes a printer with an ink tank, where the ink tank includes a main tank and a feeder tank in fluid communication with the main tank, where the feeder tank is at least partially filled with ink. The printer may also include a print cartridge with a nozzle plate to dispense ink. In one example, the printer also includes a tube to establish fluid communication between the print cartridge and a port of the feeder tank, where the port is located at a lower corner of the feeder tank distal to a center of mass of ink in the feeder tank, the print cartridge and the tube. In one example, the example system includes a screen disposed at an interface between the feeder tank and the port, and where the nozzle plate of the print cartridge is located below a free surface of ink in the feeder tank when the printer is in a first tilted orientation and the port is exposed to air in the feeder tank, and where the screen provides a negative gauge pressure at the port.

In one example, the nozzle plate is disposed above the free surface of ink in the feeder tank when the printer is in a normal operating orientation and the port is covered by ink in the feeder tank.

In one example, the nozzle plate is located above the free surface of ink in the feeder tank when the printer is in a second tilted orientation and the port is covered by ink in the feeder tank.

Thus, in accordance with various examples provided herein, systems for passive prevention of ink drool in inkjet printers have been disclosed.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A system, comprising:

an ink tank including a feeder tank, wherein the feeder tank is to hold a fluid therein, the feeder tank having a port, the feeder tank being under a negative gauge pressure; and a print cartridge in fluid communication with the port of the feeder tank, the print cartridge having a nozzle plate, wherein the port of the feeder tank is positioned to a lower corner of the feeder tank distally to the print cartridge, wherein the nozzle plate is disposed above a predetermined level within the feeder tank when the system is not tilted, the predetermined level corresponding to a free surface of a predetermined volume of the fluid when the system is not tilted, and wherein, when the system is tilted to position the nozzle plate below the port, the volume of fluid uncovers the port.

2. The system of claim 1, further comprising a screen disposed at an interface of the feeder tank and the port, wherein the screen comprises a mesh to retain fluid when the port is uncovered from the fluid, and wherein the screen is operative to increase the negative gauge pressure at the port.

3. The system of claim 2, wherein openings in the screen are in a range of between about 2 microns to about 20 microns.

4. The system of claim 2, wherein a thickness of the screen is in a range of between about 0.05 millimeters to about 0.5 millimeters.

5. The system of claim 2, wherein an active area of the screen is in a range of between about 20 square millimeters to about 500 square millimeters.

6. The system of claim 1, wherein the feeder tank includes a vent to ambient atmosphere, the vent to allow ambient air to replace ink in the feeder tank as ink is transferred from the feeder tank to the print cartridge.

7. A system, comprising:

an ink tank of a printer, comprising a main tank and a feeder tank in fluid communication with the main tank, wherein the feeder tank is at least partially filled with ink;

a print cartridge of the printer, comprising a nozzle plate;

a tube to establish fluid communication between the print cartridge and a port of the feeder tank, the port at a lower corner of the feeder tank located distally to a center of mass of ink in the feeder tank, the print cartridge and the tube; and a screen disposed at an interface between the feeder tank and the port, wherein the nozzle plate is located below a free surface of ink in the feeder tank when the printer is in a first tilted orientation and the port is exposed to air in the feeder tank, wherein the screen is operative to provide a negative gauge pressure at the port.

8. The system of claim 7, wherein air in the main tank is at a negative gauge pressure.

9. The system of claim 7, further comprising a tubular sleeve extending from the main tank into the feeder tank, wherein a transfer of air from the feeder tank to the main tank is prevented when the free surface of ink in the feeder tank is above a lower lip of the tubular sleeve, and wherein ink transfer from the main tank to the feeder tank is prevented.

10. The system of claim 9, wherein a transfer of air from the feeder tank to the main tank is enabled when the free surface of ink in the feeder tank is below the lower lip of the tubular sleeve, and wherein ink transfer from the main tank to the feeder tank is enabled.

11. The system of claim 7, wherein openings in the screen are in a range of between about 2 microns to about 20 microns.

12. The system of claim 7, wherein a thickness of the screen is in a range of between about 0.05 millimeters to about 0.5 millimeters.

13. A system, comprising:

a printer comprising an ink tank, the ink tank comprising a main tank and a feeder tank in fluid communication with the main tank, wherein the feeder tank is at least partially filled with ink, the printer further comprising a print cartridge wherein the print cartridge comprises a nozzle plate, wherein the printer further comprises a tube to establish fluid communication between the print cartridge and a port of the feeder tank, the port at a lower corner of the feeder tank located distally to a center of mass of ink in the feeder tank, the print cartridge and the tube, and wherein the printer further comprises a screen disposed at an interface between the feeder tank and the port, wherein the nozzle plate is located below a free surface of ink in the feeder tank when the printer is in a first tilted orientation and the port is exposed to air in the feeder tank, and wherein the screen provides a negative gauge pressure at the port.

14. The system of claim 13, wherein the nozzle plate is disposed above the free surface of ink in the feeder tank when the printer is in a normal operating orientation and the port is covered by ink in the feeder tank.

15. The system of claim 13, wherein the nozzle plate is located above the free surface of ink in the feeder tank when the printer is in a second tilted orientation and the port is covered by ink in the feeder tank.

* * * * *